United States Patent [19]

Craft

[11] Patent Number: 4,754,110

[45] Date of Patent: Jun. 28, 1988

[54] BARRIER SEALING MEANS FOR AN ELECTRICAL SWITCH FOR RESISTING ENTRY OF FOREIGN MATERIAL INTO THE SWITCH BODY

[75] Inventor: Kenneth E. Craft, Bolivar, Tenn.

[73] Assignee: Lucerne Products, Inc., Hudson, Ohio

[21] Appl. No.: 944,195

[22] Filed: Dec. 22, 1986

[51] Int. Cl.[4] ..... H01H 9/06; H01H 9/04; H01H 13/06; H01H 13/04

[52] U.S. Cl. ..... 200/302.2; 200/157; 200/302.1; 200/303

[58] Field of Search ..... 200/302.2, 157, 302.1, 200/306, 303, 293

[56] References Cited

U.S. PATENT DOCUMENTS

| | | | |
|---|---|---|---|
| 3,336,457 | 8/1967 | Julian et al. | 200/306 |
| 3,536,973 | 10/1970 | Matthews et al. | 200/157 X |
| 3,745,286 | 7/1973 | Sahrbacker | 200/157 |
| 3,769,481 | 10/1973 | Raab | 200/161 |
| 4,100,383 | 7/1978 | Piber | 200/157 |
| 4,241,297 | 12/1980 | Piber et al. | 200/157 X |
| 4,572,997 | 2/1986 | Yamanobe et al. | 200/157 X |
| 4,618,747 | 10/1986 | Schatteler | 200/157 X |
| 4,665,290 | 5/1987 | Piber | 200/303 |

FOREIGN PATENT DOCUMENTS

| | | | |
|---|---|---|---|
| 968213 | 9/1964 | United Kingdom | 200/302.1 |

OTHER PUBLICATIONS

Prior art switch produced for Black & Decker by Lucerne Products—as per attached photograph.

*Primary Examiner*—Henry J. Recla
*Assistant Examiner*—Ernest G. Cusick
*Attorney, Agent, or Firm*—Baldwin, Egan & Fetzer

[57] ABSTRACT

A trigger operated switch assembly for a portable hand tool such as an electric drill that includes a switch casing, housing a switch contact module and a reciprocally movable contact carrier operatively engageable with the switch contact module for controlling communication of electrical energy from a source to an electrical load. An elongated arm extends through an opening in the switch casing and operatively interconnects the movable switch contact module with trigger structure. A seal arrangement prevents or substantially inhibits the entry of foreign material into the switch casing and includes a seal located in wiping relation with the elongated arm and mounted within an opening integrally molded in the switch casing. An additional seal seals a gap between the switch contact module and an inside surface of the casing. An elastomeric cap covers an end opening of the casing and includes apertures through which electrical conductors extend and are connected with the switch contact module.

17 Claims, 1 Drawing Sheet

BARRIER SEALING MEANS FOR AN ELECTRICAL SWITCH FOR RESISTING ENTRY OF FOREIGN MATERIAL INTO THE SWITCH BODY

DESCRIPTION

1. Technical Field

This invention relates generally to electrical switches and in particular to a finger operated trigger switch of the type used to control a portable power tool such as an electric drill.

2. Background Art

Finger operated power switches are normally found on electrically powered portable hand tools. These switches normally include a trigger operated by finger pressure that is located on the outside of the tool housing and accessible by the operator. In normal operation, the trigger is squeezed by the operator to activate the power tool.

An example of a trigger operated switch can be found in U.S. Pat. No. 3,745,286 which is owned by the present assignee. Briefly, the switch disclosed in this U.S. patent includes a contact carrier reciprocally movable with respect to fixed contacts located in a casing. The movable carrier is operated by trigger structure interconnected with the carrier by an elongated arm. The trigger structure is spring biased towards an OFF position.

Portable hand tools are often exposed to harsh environments or environments in which foreign material is present in the immediate vicinity of the tool being used. For example, when using a portable electric drill or saw, air borne shavings and/or sawdust are created. The entry of foreign material such as sawdust into the tool, specifically the control switch can cause intermittent and/or unreliable operation.

It would be desireable to inhibit or reduce the possibility of contamination of the switch mechanism. However, it is equally important to minimize the cost of components used in the tool. It is believed that expensive modifications to the tool and/or the switch intended to prevent the entry of contaminants into the control switch are not commercially acceptable.

DISCLOSURE OF THE INVENTION

The present invention provides a new and improved switch assembly for a power tool such as an electric drill that includes structure for resisting the entry of dust and other contaminants into a switch contact region.

According to the preferred and illustrated embodiment, the switch assembly is similar in configuration to the switch disclosed in the above identified U.S. Pat. No. 3,745,286. In particular, the switch assembly is trigger actuated and includes a casing for housing a reciprocal contact carrier that is supported within the casing for longitudinal, reciprocal motion. An elongated arm extends outwardly from the carrier and extends into operative engagement with an operator actuated element such as a trigger. Movement of the trigger causes reciprocal movement in the carrier to cause engagement and disengagement of switch contacts. According to the invention, a filter and/or seal arrangement forming part of the switch assembly operates to resist the entry of dust and other contaminants into the switch casing.

In the preferred and illustrated embodiment, the filter arrangement includes at least one filter formed from a plug of fibrous material that is mounted in the casing in dust sealing relation with a contact assembly and operates to inhibit the entry of dust into the interior of the casing. The fibrous material is preferably formed from fiberglass which is relatively inexpensive and readily available.

In the preferred and illustrated embodiment, the switch assembly includes an open bottom casing which is adapted to slidably receive and engage a switch contact module. The casing defines abutments which are adapted to slidably engage portions of the module. In the preferred and illustrated embodiment, a filter is disposed between the module and an interior surface of an end wall of the casing in order to seal the interior of the casing from dust and dirt entry.

According to a feature of the invention, the casing includes an extending portion that projects longitudinally. The extension is formed such that in transverse section it is generally U-shaped and defines a channel in which a portion of the elongated operating arm reciprocally slides. The arm extends through an opening formed in the casing and aligned with the channel.

In accordance with the invention, structure defined by the casing locates and supports a seal disposed in wiping relation with the arm. The seal inhibits the entry of dust or other contaminants through the opening and in the casing (through which the operating arm extends). In the preferred embodiment, the structure for supporting the seal is integrally molded in the casing and does not significantly add to the cost of manufacturing the switch assembly.

According to still another feature of the invention, the filter arrangement also includes a cap, preferably formed from a flexible plastic material which snugly engages a portion of the casing and substantially seals the open end of the casing (through which the switch contact module is inserted). In the preferred and illustrated embodiment, the flexible cap includes a horizontal bottom wall and upstanding side walls and apertures in the bottom wall for receiving conductors by which the switch is connected to the power tool motor and to the source of electrical power. Preferably, the apertures in the cap are aligned with conductor receiving structure forming part of the switch contact module such that once the switch is assembled and the wires are connected, the open end of the casing is substantially sealed to inhibit the entry of dust and other particulate matter. In the preferred embodiment, the cap is formed from a low density polyvinyl chloride plastic.

Accordingly, it is a general object of the invention to provide a switch assembly for use in power hand tools which includes filter and seal arrangement for inhibiting the entry of dust and other foreign matter into the inner workings of the switch assembly.

It is another object of the invention to provide a sealing arrangement for a power tool switch assembly that is inexpensive and which does not compromise the operation of the switch assembly.

Additional features of the invention will become apparent and a fuller understanding obtained by reading the following detailed description made in connection with the accompanying drawings.

BEST MODE FOR CARRYING OUT THE INVENTION

Although the invention is shown and described herein with reference to its application in a portable electric tool, it will be understood that the invention may be used in other applications in which mechanical switches are used to control the application of electrical energy to an electric appliance.

Figure 1:
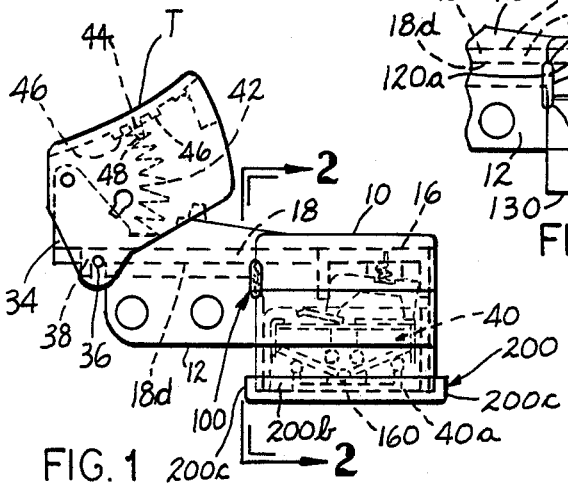
FIG. 1 is a side elevational view of a switch assembly constructed in accordance with the invention.
Figure 4:
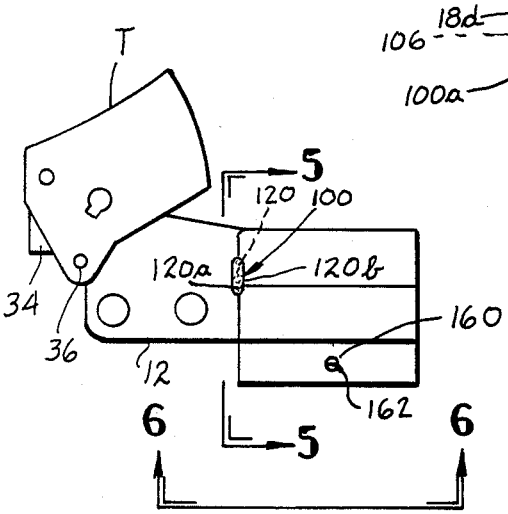
FIG. 4 is a side elevational view of the switch assembly.

FIGS. 1 and 4 illustrate the overall construction of a switch device that embodies the present invention. The switch assembly includes a switch casing or body 10 which encases a trigger actuator switch mechanism that is disclosed and claimed in the assignee's prior U.S. Pat. No. 3,536,973 which issued on Oct. 27, 1970.

The switch casing 10 has an extended frame portion 12 formed integral with the casing 10. A movable contact carrier 16 is disposed in the casing 10 and has integral elongated arm 18 extending outwardly from the carrier in the direction of the frame portion 12.

A bell crank trigger T is pivotally mounted on the free outer end 34 of the frame portion 12. The bell crank trigger T is pivotally connected to an outer end 38 of the arm 18 at a pivot 36. The trigger T is biased upwardly (as viewed in FIG. 1) by a coil spring 42 that is located by a spring seat 44. The spring seat is defined by ribs 46 and a projection 48 formed on the underside of an outer end portion of the trigger T.

A switch contact module 40 is mounted within the casing 10 and includes contacts that are engageable by movable contacts forming part of the movable contact carrier 16. As viewed in FIGS. 1 and 4, when the trigger T is pushed downwardly, the arm 18 moves towards the left and moves the movable contact carrier 16 from its right position shown in FIG. 1 towards its left position (not shown). The construction of the switch module 40 and movable contact carrier 16 forms no part of the present invention but is fully described in assignee's aforementioned U.S. Pat. Nos. 3,536,973 and 3,745,286 both of which are hereby incorporated by reference.

According to the invention, filter and seal elements inhibit or restrict the entry of contaminants into the casing 10 and in particular inhibit the entry of foreign material between the switch module 40 and the inside of the casing 10 and/or movable contact carrier 16.

Referring to FIGS. 1, 2, 4 and 5, a seal 100 is positioned in wiping contact with the carrier actuating arm 18. As seen best in FIG. 5, the extended frame portion 12 forming part of the casing 10 is substantially inverted U-shaped in cross section having one leg of the U larger than the other. In this configuration, the extended frame portion 12 defines a channel or trackway 102 which slidingly engages three sides, labelled 18*a*, 18*b* and 18*c* of the extended carrier arm 18. As should be apparent, the arm 18 passes through an aperture formed in the casing 10, the boundries of which are defined by surfaces 106, 108, 110 and 112. To inhibit the entry of foreign material into the casing 10, the seal 100 covers the exposed casing opening below the carrier arm 18 and wipingly engages the bottom surface 18*d* (as viewed in FIG. 5) of the carrier arm 18.

Figure 2:
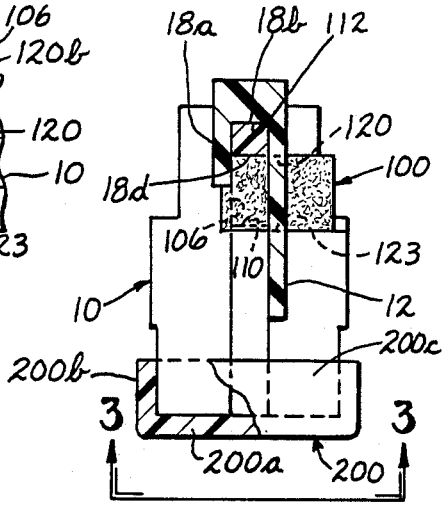
FIG. 2 is a sectional view of the switch assembly as seen from the plane indicated by the line 2—2 in FIG. 1.
Figure 5:
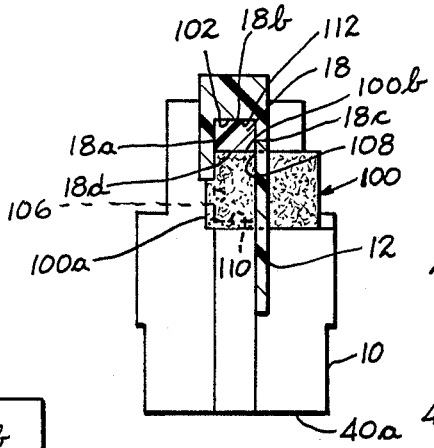
FIG. 5 is a sectional view of the switch assembly as seen from the plane indicated by the line 5—5 in FIG. 4.

As seen in FIGS. 2 and 5, the seal is rectangular in shape and is preferably constructed of a fibrous material such as fiberglass. With the preferred seal construction, the seal does not apply a substantial frictional force to the arm to restrict or inhibit its movement.

Figure 8:
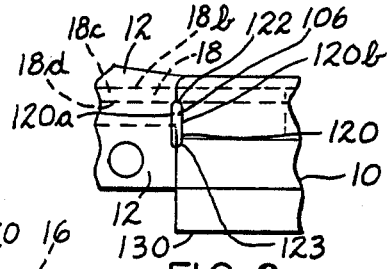
FIG. 8 is a fragmentary, side elevational view of the switch assembly with a seal removed to show additional details of a switch casing.

Referring also to FIG. 8, the preferred construction, structure integrally molded into the casing 10 and extended casing frame portion 12 mounts and maintains the main position of seal 100. As seen best in FIG. 8, an elongated opening 120 is defined between the main casing 10 and the extended casing frame 12. In the preferred construction, substantially the left half of the opening 120 (as viewed in FIG. 8) is formed by a cutout 120*a* molded into the extended frame 12. The right half of the opening (as viewed in FIG. 8) is defined by a recess 120*b* integrally formed in the main casing 10. The upper and lower boundaries of the opening are defined by curved surfaces 122, 123.

The vertical dimension as measured along the center line of the opening (as viewed in FIG. 8) is sized to be substantially the same or slightly smaller than the vertical dimension of the seal 100 so that when the seal 100 is inserted into the opening 120 it is snugly held within the opening. As seen best in FIG. 5, the seal 100 is mounted so that its left end face 100*a* (as viewed in FIG. 5) abuttably engages the side surface 106 defined by the casing 10. An apex of the upper curved surface 122 is located such that it is substantially in line with the lower surface 18*d* of the actuating arm 18 in order to allow the upper edge 100*b* of the seal 100 to slidingly contact the surface 18*d*. After the seal 100 is inserted into the opening 120, the entry of foreign material or contaminants into the casing is substantially inhibited.

Figure 3:
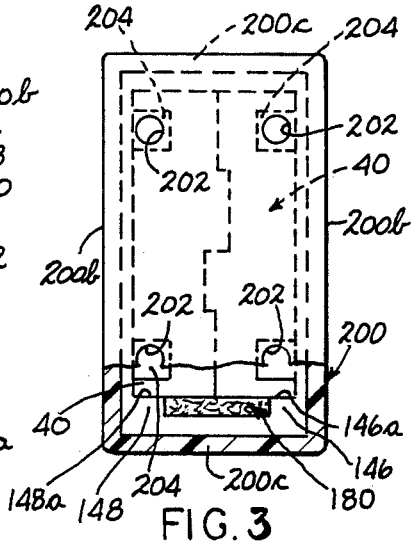
FIG. 3 is a bottom view, partially in section as seen from the plane indicated by the line 3—3 in FIG. 2.
Figure 6:
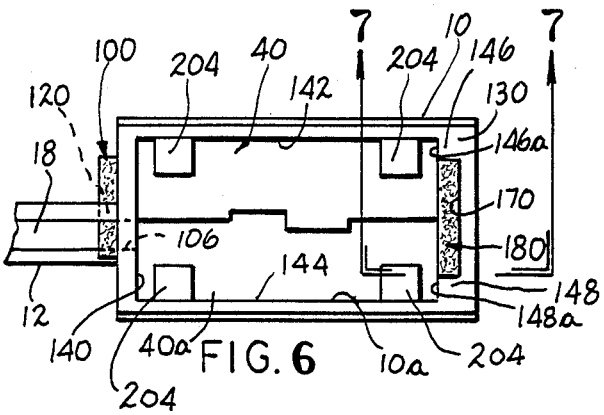
FIG. 6 is a bottom view of the switch assembly, as seen from the plane indicated by the line 6—6 in FIG. 4.
Figure 7:
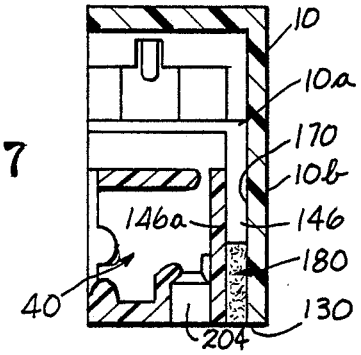
FIG. 7 is a sectional view of the switch assembly as seen from the plane indicated by the line 7—7 in FIG. 6.

FIGS. 3, 6 and 7 illustrate an additional seal for inhibiting the entry of foreign material into the main casing 10. As indicated above, a switch contact module 40 is securely mounted at a lower region of a recess 10*a* defined by the casing 10 such that a lower surface 40*a* of the module 40 is flush with an end surface 130 of the casing 10. In the preferred construction of the casing 10, inside walls 140, 142, 144 along with a pair of spaced apart side surfaces 146*a*, 148*a* defined by abutments 146, 148 (shown in FIG. 6) locate the module 40 in its installed position. Although not part of the invention, it should be noted that the module 40 is maintained in position by a pair of trunnions 160 forming part of the module 40 (only one trunnion is shown in FIG. 1) which snap into apertures 162 formed in the casing. The casing 10 is preferably constructed of a plastic material which is elastically deformable to some extent to enable the trunnions 160 to move past the side walls of the casing and into the apertures 162.

The spaced apart abutments 146, 148 are integrally formed in a side wall 10*b* of the casing 10 and as seen best in FIG. 6 define a channel 170 which preferably extends from the bottom end surface 130 of the casing 10 to a top area 10*a* defined by the casing 10.

According to the invention, a seal 180 is inserted into the channel 170 in order to close off the opening to prevent the entry of contaminants. In the preferred embodiment, the seal is constructed of a fibrous material such as fiberglass and preferably is similar in construction to the seal 100. The seal is sized so that it snugly fits within the channel 170 and sealingly abuts a side surface of the module 40 and the three surfaces that define the channel 170.

Turning now to FIGS. 2 and 3, an additional sealing cap or boot 200 may be provided for enclosing the entire lower end opening of the main casing 10. The cap 200 is preferably formed from a low density polyvinyl chloride plastic and is elastomeric. The cap 200 includes a generally horizontal bottom wall 200*a*, and upstanding side walls 200*b*, 200*c*. By constructing the cap of an elastomeric material, the upstanding side walls 200*b*, 200*c* can snugly grip side walls of the casing 10 in order to maintain position of the cap on the casing.

According to a feature of the invention, the cap includes a plurality of apertures 202 which are aligned with wire receiving openings 204 in the module 40 when the cap 200 is installed. The apertures 202 may be sized such that wires extending through the apertures and engaged by the module 40 are circumferentially engaged by the cap so that no clearance or gaps are created between the wires and the apertures through which foreign material could enter the casing.

It should be appreciated that if all three seal elements 100, 180 and 200 are employed, the entry of foreign material into the casing 10 is prevented or substantially inhibited. The disclosed sealing arrangement is both highly effective and inexpensive to incorporate into a trigger actuator switch of the type disclosed and does not add significant manufacturing cost to the switch that would otherwise make the switch prohibitively expensive.

Although the invention has been described with a certain degree of particularity, it should be understood that those skilled in the art can make various changes to it without departing from the spirit or scope of the invention as hereinafter claimed.

I claim:

1. In an electrical switch for portable electric motor driven tools comprising a casing having a lower end defining an underside and also having an opening, said casing defining an interior, a trigger actuated switch device disposed in said casing, a reciprocal contact carrier reciprocally disposed in said casing for recriprocation longitudinally with respect to said casing, an elongated arm extending outwardly from said carrier longitudinally of said casing, means including a trigger operatively coupled to said arm for causing longitudinal movement of said arm and said carrier, a portion of said switch device being supported in said carrier whereby reciprocation of said carrier in said casing actuates said switch device, said switch device also comprising a module received through said opening and into said casing, said module having means adapted for connection to a source of power and to a motor for the associated tool, and flexible filter means on said casing coacting with said lower end for resisting entry of dust and other contaminants through said opening in said casing which communicates with said interior of said casing and said switch device.

2. A switch in accordance with claim 1 wherein said filter means comprises a plug of fibrous material mounted on said casing between said casing and said module and in dust sealing relation therewith.

3. A switch in accordance with claim 2 wherein said plug of fibrous material comprises a pad formed of fiberglass.

4. A switch in accordance with claim 1 wherein said filter means comprises a cap or boot formed of elastomeric material snugly coacting in encompassing relation with said lower end of said casing in sealing relationship.

5. A switch in accordance with claim 4 wherein said cap comprises a generally horizontal bottom wall and upstanding side walls and apertures in said bottom wall for receiving therethrough connecting wires from a power tool, for connecting the switch to the power tool and to a source of current.

6. In an electrical switch for portable electric motor driven tools comprising a casing defining a bottom portion and an interior, and having opening means, a trigger actuated switch-device disposed in said casing, a reciprocal contact carrier reciprocally disposed in said casing for reciprocation longitudinally with respect to said casing, an elongated arm extending outwardly from said carrier longitudinally of said casing, means including a trigger operatively coupled to said arm for causing longitudinal movement thereof, a portion of said switch device being supported in said carrier whereby reciprocation of the contact carrier in said casing actuates said switch device, and filter means on said casing for resisting entry of dust and other contaminants through said opening means therein communicating with said interior of said casing and said switch device, and wherein said filter means comprises a flexible plug of fibrous material coacting with said longitudinal reciprocal arm, a plug of fibrous material coating between said casing and said switch device in said bottom portion of said casing, and a flexible cap received in gripping coaction with said bottom portion of said casing and encompassing said bottom portion.

7. A switch in accordance with claim 6 wherein said cap is fomred of a low density polyvinyl chloride plastic.

8. A switch in accordance with claim 6 wherein said plugs of fibrous material are formed of fiberglass.

9. In an electrical switch for portable electric motor driven tools comprising a casing defining an interior and having an opeing communicating with said interior, a trigger actuated switch device disposed in said casing, a reciprocal contact carrier reciprocally disposed in said casing for reciprocation longitudinally with respect to said casing, an elongatged arm having an underside and extending outwardly from said carrier longitudinally of said casing, means including a trigger operatively coupled to said arm for causing longitudinal movement thereof, a portion of said switch device being supported in said carrier whereby reciprocation of the said carrier in said casing actuates said switch device, and filter means on said casing for resisting entry of dust and other contaminants through said opening therein communicating with said interior of said casing and said switch device, and wherein said casing includes a main casing portion having an inner side surface and an extended casing portion projecting longitudinally forwardly of said main casing portion, said extended portion being in transverse section of generally inverted channel-shape configuration having an inner surface, said arm being slidably movable in said inverted channel-shape configuration of said extended casing portion and through said opening, and said filter means comprising a removable flexible fibrous plug extending through a further opening located in said extended casing portion adjacent said main casing portion to cover a portion of the first mentioned opening which said opening portion is disposed below said arm, said further opening having upper and lower ends, and said plug extending into wiping contact with said underside of said arm, said further opening being formed paratially in said extended casing portion and partially in said main casing portion with said plug of fibrous material being received in said further opening in generally snug relation with said plug extending inwardly transverse of said main casing portion and said extended casing portion and abutting said inner side surface of said main casing portion and said inner surface of said channel-shape configuration of said extended casing portion, said upper and lower ends of said further opening being arcuately configured and with said upper end being substantially disposed in line with said underside of said arm for providing sliding contact of said underside of said arm with said plug during said longitudinal movement of said arm.

10. A switch in accordance with claim 9 wherein said extended casing portion comprises a free outer end with a projection having an upper end and said arm including an outer end portion, and wherein said portion of said switch device comprises a substantially U-shpaed contact movably received in a pocket in said contact carrier, bias means in said contact carrier urging said contact outwardly of said contact carrier, said trigger coprising a bell crank member having one end and pivotally mounted adjacent said one end thereof on said upper end of said projection on said free outer end of said extended casing portion above said outer end portion of said arm, for rotation in a longitudinal vertical plane of said carrier, said end of the bell crank trigger member having a transverse pivot thereon pivotally coupled to said outer end portion of said arm to form a pivotal connection between the trigger member and the arm, compressed coil spring bias means disposed between said extended casing portion and said trigger member to bias the trigger member and said switch device to a first preselected position, and whereby predetermined displacement of said trigger member against the action of the second mentioned bias means displaces said contact carrier to a second preselected position, said fibrous plug being deformable and snugly engaging said inner confronting side surface of said channel-shape extended casing portion.

11. In an electrical switch for portable electric motor driven tools comprising a casing having opening means therein, and an interior, a trigger actuated switch device disposed in said casing, a reciprocal contact carrier reciprocally disposed in said casing for reciprocation longitudinally with respect to said casing, an elongated arm extending outwardly from said carrier longitudinally of said casing, means including a trigger operatively coupled to said arm for causing longitudinal movement thereof, a portion of said switch device being supported in said carrier whereby reciprocation of the contact carrier in said casing actuates said switch device, said switch device including a module received through said opening means into said interior, filter means on said casing for resisting entry of dust and other contaminants through said opening means therein communicating with said interior of said casing and said switch device, and wherein said casing comprises a bottom member having said opening means therein and into which is adapted to be received said module of said switch device, said module comprising a confronting end and said bottom member comprising a confronting end wall having an interior surface, said casing also defining positioning abutments therein which are adapted for sliding engagement with said confronting end of said module for guiding and locating said module in said bottom member of said casing, and said filter means being disposed between said module and said interior surface of said confronting end wall of said bottom member of said casing for resisting entry of dust and other contaminants into said interior of said casing and said switch device.

12. A sealing cap or boot for an electrical switch having a casing with an open bottom portion, and with the switch adapted for use in controlling portable electric tools, said cap comprising, a bottom wall and upstanding side walls defining a recess into which the bottom portion of the casing of an associated electrical switch is adapted to be received, said cap being formed of flexible elastomeric material and adapted to removably adhre in encompassing relation to the open bottom portion of the casing of the associated electrical switch, whereby the side walls of said cap grip the bottom portion of the casing for maintaining the cap on the associated electrical switch while resisting entry of dust and other contaminants into the associated switch, and openings in said bottom wall for wiring the associated switch through said cap to a motor of an associated tool and to a source of power.

13. A cap in accordance with claim 12 wherein said openings are circular and of such size so as to generally snugly receive electrical wire therethrough, said cap being formed of low density polyvinyl chloride plastic.

14. In combination, a cap for an electrical switch and an electrical switch adapted for use in controlling portable electric tools, said switch comprising a casing with an open bottom portion defining an interior, said cap being formed of flexible elastomeric material and comprising a bottom wall and upstanding side walls defining a recess receiving thereon said bottom portion, said switch including a switch module, said open bottom portion of said casing receiving in such interior said switch module, said cap being disposed in snug encompassing relation to said open bottom portion of said casing and removably adhering thereto for closing said open bottom portion and holding said cap on said bottom portion while resisting entry of dust and other contaminants into said interior of said bottom portion of said casing, and said switch module, and openings in said bottom wall of said cap for wiring the switch through said cap to a motor of an associated tool and to a source of electric power.

15. The combination in accordance with claim 14 wherein said bottom portion of said casing is of generally retangular configuration in bottom plan with said configuration having a greater dimension in the longitudinal direction as compared to the transverse direction, said bottom portion including a bottom surface, said bottom wall of said cap abuttingly engaging said bottom surface of said bottom portion of said casing.

16. The combination in accordance with claim 15 wherein said switch module includes a confronting end and said bottom portion includes positioning abutments therein adapted for sliding engagement with said confronting end of said module for guiding and locating said module in said interior, said module having an underside and having wire receiving openings in said underside thereof for connecting said module through said cap openings to the motor and to the source of electric power, said cap being generally retangular in plan and including perimeter defining end edges, and also including corners, each of said openings in said bottom wall of said cap being generally aligned with a respective one of said wire receiving openings in said module, and being disposed generally adjacent a respective of said corners of said cap, said openings in said bottom wall being disposed in pairs, with one pair of said bottom wall openings being disposed a smaller distance from the associated of said perimeter defining end edges of said cap as compared to the distance of the other pair of said bottom wall openings to their associated said permimeter defining end edges of said cap.

17. In an electrical switch for portable electrical motor driven tools comprising a casing having an underside and an interior and an opening communicating with said interior, a switch device including a module disposed in said casing, said module having a confronting end, a reciprocal contact carrier disposed on said casing for reciprocation longitudinally with respect to said casing, a portion of said switch device being supported in said carrier whereby reciprocation of said carrier in said casing actuates said switch device, filter means on said casing for resisting entry of dust and other contaminants through said opening in said underside thereof communicating with said interior of said casing, and with said switch device, and wherein said casing comprises an open bottom member defining said opening and into which is received through said oepning said module of said switch device, said bottom member including a confronting end wall with an interior surface, said casing defining positioning abutments therein which are adapted for sliding engagement with said confronting end of said module during its assembly through said opening into said bottom member for guiding and locating said module in said open bottom member of said casing, and said filter means comprising a plug of fibrous material disposed between said confronting end of said module and said interior surface of said confronting end wall of said bottom member for resisting entry of dust and other contaminants through said opening into said interior of said casing, and said switch device.

* * * * *